US005993171A

United States Patent [19]

Higashiyama

[11] Patent Number: 5,993,171

[45] Date of Patent: Nov. 30, 1999

[54] SCROLL-TYPE COMPRESSOR WITH VARIABLE DISPLACEMENT MECHANISM

[75] Inventor: Akiyoshi Higashiyama, Sawa-gun, Japan

[73] Assignee: Sanden Corporation, Gunma, Japan

[21] Appl. No.: 08/880,717

[22] Filed: Jun. 23, 1997

[30] Foreign Application Priority Data

Jun. 25, 1996 [JP] Japan ..... 8-163999

[51] Int. Cl.[6] ..... F04B 49/00

[52] U.S. Cl. ..... 417/310; 417/308

[58] Field of Search ..... 417/310, 308

[56] References Cited

U.S. PATENT DOCUMENTS

| | | |
|---|---|---|
| Re. 34,148 | 12/1992 | Terauchi et al. . |
| 2,350,537 | 1/1944 | Scott . |
| 3,253,607 | 5/1966 | Drutchas . |
| 3,759,057 | 9/1973 | English et al. . |
| 4,383,805 | 5/1983 | Teegarden et al. . |
| 4,431,388 | 2/1984 | Eber et al. . |
| 4,459,817 | 7/1984 | Inagaki et al. . |
| 4,468,178 | 8/1984 | Hiraga et al. . |
| 4,505,651 | 3/1985 | Terauchi et al. . |
| 4,557,670 | 12/1985 | Inagaki et al. . |
| 4,566,863 | 1/1986 | Goto et al. . |
| 4,642,034 | 2/1987 | Terauchi . |
| 4,717,314 | 1/1988 | Sato et al. . |
| 4,744,733 | 5/1988 | Terauchi et al. . |
| 4,747,756 | 5/1988 | Sato et al. . |
| 4,846,633 | 7/1989 | Suzuki et al. . |
| 4,890,987 | 1/1990 | Sato et al. . |
| 4,904,164 | 2/1990 | Mabe et al. . |
| 4,940,395 | 7/1990 | Yamamoto et al. . |
| 5,059,098 | 10/1991 | Suzuki et al. . |

(List continued on next page.)

FOREIGN PATENT DOCUMENTS

| | | |
|---|---|---|
| 144169 | 11/1984 | European Pat. Off. . |
| 297840 | 6/1988 | European Pat. Off. . |
| 0519580 | 12/1992 | European Pat. Off. . |
| 1035170 | 3/1957 | Germany . |
| 3804418 | 2/1988 | Germany . |
| 60-101295 | 6/1985 | Japan . |
| 62-91680 | 4/1987 | Japan . |
| 63-212789 | 9/1988 | Japan . |
| 1-106990 | 4/1989 | Japan . |
| 1-318777 | 12/1989 | Japan . |
| 3-92592 | 4/1991 | Japan . |

*Primary Examiner*—Charles G. Freay
*Attorney, Agent, or Firm*—Baker & Botts, L.L.P.

[57] ABSTRACT

A scroll-type variable displacement compressor for use in an air conditioning system of a vehicle has a fixed scroll and an orbiting scroll with a lowered minimum operating capacity. A cylinder is formed within an end plate of the fixed scroll and accommodates a capacity control mechanism and a plurality of pairs of bypass holes which penetrate the end plate of the fixed scroll and the cylinder perpendicularly. Via one of a pair of bypass holes, the cylinder communicates with a compression chamber enclosed by the orbiting scroll and the fixed scroll, and via the other of the pair of bypass holes, the cylinder communicates with a low pressure chamber provided within rear portions of a compressor housing. One portion of the low pressure chamber is always open to the suction chamber. The communication between the cylinder and the low pressure chamber is controlled by the position of a piston slidably accommodated within the cylinder. When the thermal load for the air conditioning system is low, the piston retreats to the recessed position of the cylinder, opening the pairs of bypass holes. By providing the low pressure chamber, an extra branch path for returning refrigerant gas is formed, in addition to the conventional returning path. Thus, pressure loss from the compression chamber through the suction chamber is effectively reduced. As a result, the capacity control mechanism of the present invention increases the feed back of refrigerant gas from the compression chamber to the suction chamber. Thus, the capacity control mechanism of the present invention lowers the minimum operating capacity more than that of a conventional device, without any undesired increase in the size or weight of the compressor.

3 Claims, 7 Drawing Sheets

U.S. PATENT DOCUMENTS 5,240,388 8/1993 Matsumoto et al. .
5,253,489 10/1993 Yoshii .
5,336,058 8/1994 Yokoyama .
5,451,146 9/1995 Inagaki et al. .
5,577,897 11/1996 Inagaki et al. ..... 417/310
5,639,225 6/1997 Matsuda et al. ..... 417/299

SCROLL-TYPE COMPRESSOR WITH VARIABLE DISPLACEMENT MECHANISM

BACKGROUND OF THE INVENTION

1. Field of the Invention

The present invention relates to a scroll-type compressor with a variable displacement mechanism. More particularly, it relates to a scroll-type compressor with a variable displacement mechanism for which the minimum operating capacity is improved.

2. Description of the Related Art

Generally, a method of returning a portion of refrigerant gas in the compression chamber to the suction chamber is known in the field of scroll-type compressors. FIG. 1 is a cross-sectional view of a prior art conventional compressor 1' according to Japanese Patent Publication Hei 5-280476. In FIG. 1, the capacity control mechanism 600 is comprised of cylinder 510, which is formed within the end plate 501 of fixed scroll 500; a plurality of bypass holes 530, which allow compression chambers 520*a,* 520*b* to be in communication with the cylinder 510; a plunger 540, which can open or close bypass holes 530 sequentially; and a mechanism, which regulates the position of plunger 540 along the axis of the cylinder 510. The outermost one of bypass holes 530 permits cylinder 510 to be in communication with suction chamber 550. The mechanism that regulates the position of plunger 540 is comprised of control valve assembly 560, control pressure chamber 570, spring 580, and stopper 590. Control valve assembly 560 regulates the pressure in control pressure chamber 570, so as to increase that pressure when the thermal load for the air conditioning system is high, and decrease it when the thermal load is low. Accordingly, when the thermal load is high, plunger 540 is pushed in a radially outward direction within the compressor by the pressure in control pressure chamber 570, so that bypass holes 530 are closed sequentially. As a result, the return of the refrigerant gas from compression chambers 520*a,* 520*b* to suction chamber 550 is blocked, and the compressor operates at its maximum capacity. When the thermal load is low, the force exerted by spring 580 overcomes the counter force exerted by the pressure in control pressure chamber 570, and, therefore, plunger 540 is pushed in a radially inward direction within the compressor, so that bypass holes 530 open sequentially. As a result, the return of the refrigerant gas from compression chambers 520*a,* 520*b* to suction chamber 550 is allowed, and the capacity of the compressor is decreased automatically.

When the thermal load is very small, plunger 540 is in the most recessed position within cylinder 510, opening all bypass holes 530. In this state, part of the refrigerant gas in compression chamber 520*a,* for example, returns to suction chamber 550 via the path L1' as indicated in FIG. 1. The compressor is expected to operate at about its minimum capacity, for example, at about 25 percent of the full capacity of the compressor.

However, in a compressor according to the prior art, minimum operating capacity does not decrease to the 25 percent due to the prior art's design. The design impedes the compressor from going down to its expected lower limit of capacity, due to path resistance against the returning gas from compression chambers 520*a,* 520*b* to suction chamber 550. The path resistance is affected by various factors, such as the diameter of bypass holes 530, the cross-sectional area of cylinder 510, the length of the path, and the bendings of the path for the returning gas. This phenomenon of path resistance manifests itself as a large pressure loss which means that the pressure difference between the compression chamber, from which the returning gas departs, and the suction chamber, which receives the returning gas, is large. For a long time, it has been desired to reduce the pressure loss of returning gas in a capacity control mechanism in order to secure a sufficient quantity of returning gas and to realize the expected minimum capacity.

There are physical restrictions, however, that limit the ability to improve path resistance. For example, the diameter of the bypass holes may not be larger than the thickness of the spiral element 502 without causing undesired communication between neighboring compression chambers when the bypass holes are closed by plunger 540. Similarly, the cross-sectional diameter of cylinder 510 may not be any larger than the thickness of end plate 501 of fixed scroll 500. Moreover, if the thickness of the end plate 501 is increased for the purpose of providing a larger cross-sectional diameter of cylinder 510, the size in the axial direction of the compressor and weight of the compressor are undesirably increased.

SUMMARY OF THE INVENTION

It is a primary object of the present invention is to provide a scroll-type variable displacement compressor equipped with a capacity control mechanism, which permits the minimum operating capacity to be lowered effectively without increasing the axial dimensions of the compressor or increasing the weight of the compressor.

A scroll-type variable displacement compressor for use with refrigerant gas comprises a housing; a front plate; a drive shaft; an orbiting scroll; a converting mechanism to convert rotational motion of the drive shaft into orbiting motion for the orbiting scroll; a mechanism to prevent rotational motion of the orbiting scroll; a fixed scroll; a piston valve mechanism which provides a first return path for a portion of refrigerant gas from a plurality of compression chambers enclosed by the orbiting scroll and the fixed scroll to a suction chamber of the compressor, the first return path being provided for capacity control; a control valve mechanism which supplies a control pressure to the piston valve mechanism; and a low pressure chamber which provides a second return path for a portion of the returning refrigerant gas. The piston valve mechanism comprises a cylinder which is formed within an end plate of the fixed scroll so that an axis of the cylinder lies in a plane perpendicular to a longitudinal axis of the compressor; a plurality of pairs of bypass holes formed in an interior surface of the cylinder, which bypass holes penetrate the end plate of the fixed scroll and the cylinder perpendicularly from one or more of the compression chambers through the low pressure chamber; a piston which is slidably accommodated within the cylinder to open or close the bypass holes; a coil spring which urges the piston in a direction opposite a force of the control pressure; a stopper which limits displacement of the piston; and a snap ring which retains the piston and the coil spring within the cylinder. The low pressure chamber is disposed within a portion of the housing and is in communication with the suction chamber at all times.

Other objects, features, and advantages of this invention will be understood from the following detailed description of the preferred embodiments of this invention with reference to the attached drawings.

DETAILED DESCRIPTION OF PREFERRED EMBODIMENTS

Figure 2:
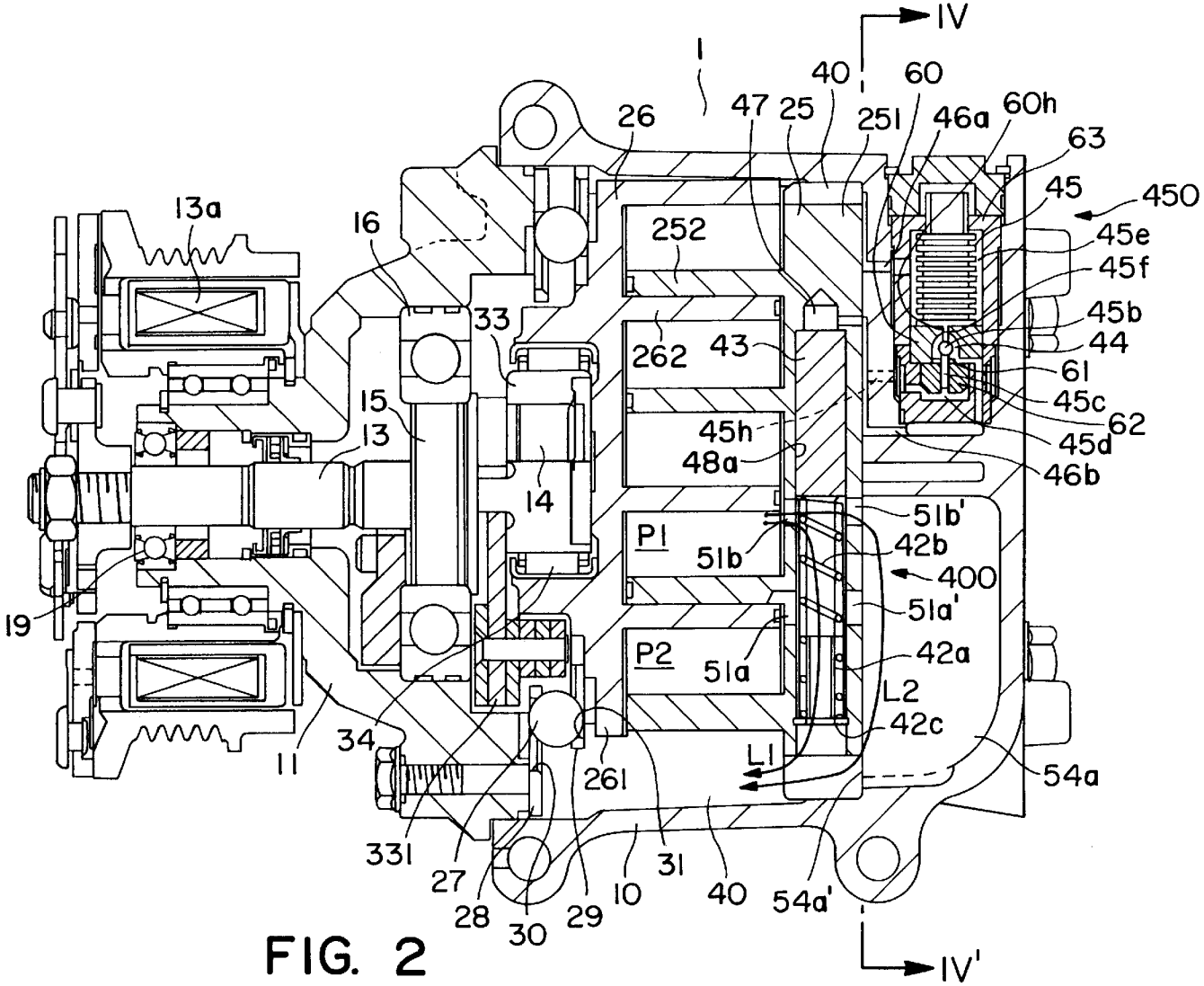
FIG. 2 is a cross-sectional view of a scroll-type variable displacement compressor according to a first embodiment of the present invention.

A first embodiment of the present invention will now be described referring to FIGS. 2–4. As shown in FIG. 2, a scroll-type compressor 1 has a housing 10 and a front plate 11 connected thereto. In the housing 10, a fixed scroll 25 is fixedly disposed and an orbiting scroll 26 is provided.

Fixed scroll 25 includes a disk-shaped fixed end plate 251, and a fixed spiral element 252 formed integrally with and extending from an end surface of fixed end plate 251. Likewise, orbiting scroll 26 includes a disk-shaped orbiting end plate 261, and an orbiting spiral element 262 formed integrally with and extending from an end surface of orbiting end plate 261. As both spiral elements 252 and 262 slide against each other, a plurality of compression chambers P1, P2 are formed between fixed scroll 25 and orbiting scroll 26.

In the front plate 11, a drive shaft 13 is rotatably supported by radial bearings 16 and 19. An eccentric pin 14 axially projects from an axial end surface of a large diameter portion 15 of the drive shaft 13. A counter weight 331 is secured to the proximal end side of the eccentric pin 14. A bushing 33 is fitted on the free end of the eccentric pin 14. Orbiting scroll 26 is rotatably supported on the bushing 33 by bearing 34.

A fixed ring 28 is secured to an axial end surface of front plate 11, facing the orbiting scroll 26 with an orbiting ring 29 secured to an end surface of orbiting scroll 26. A plurality of circular revolution position regulating holes 30 and 31 are bored at equal intervals in fixed ring 28 and orbiting ring 29, respectively. Position regulating holes 30 and 31 are arranged in facing pairs, and a transmission shoe 27 is provided between each such facing pair of position regulating holes 30 and 31.

Fixed ring 28, orbiting ring 29, and transmission shoes 27 constitute a rotation preventing device. The action of the rotation preventing device allows orbiting scroll 26 to orbit without rotating as eccentric pin 14 revolves.

When this scroll-type compressor is used as a compressor in a vehicular air conditioning system, drive shaft 13 is coupled to the driving system of the engine of the vehicle through an electromagnetic clutch 13*a*. When drive shaft 13 rotates in accordance with the rotation of the engine, the rotation of drive shaft 13 is transmitted via pin 14, bushing 33 and the rotation preventing device connected to orbiting scroll 26. As a result, orbiting scroll 26 revolves around the axis of fixed scroll 25.

As orbiting scroll 26 orbits, orbiting spiral element 262 gradually reduces the volume of the compression chambers P1, P2 to the final compression stage. Referring to FIG. 3, the compressed refrigerant gas pushes open a discharge valve 53*b* that is provided outside a discharge port 53*a*. The compressed gases are thereby discharged into the discharge chamber (not shown).

Referring again to the FIG. 2, the capacity control mechanism according to the first embodiment of the present invention is comprised of piston valve mechanism 400, which is provided within end plate 251; control valve mechanism 450; and low pressure chamber 54*a,* which is provided within a portion of rear side of housing 10.

Piston valve mechanism 400 is comprised of cylinder 48*a* which is formed, e.g., hollowed out, within end plate 251 in a direction perpendicular to a longitudinal axis of compressor; a piston 43 accommodated slidably in cylinder 48*a;* a coil spring 42*b* which urges piston 43 in the direction of operating chamber 47 (identified below); a stopper 42*a* which restricts the outward movement of piston 43; and a snap ring 42*c*. Snap ring 42*c* retains the other parts of the piston valve mechanism 400 within cylinder 48*a*. In a recessed portion of cylinder 48*a,* an operating chamber 47 is provided with a diameter less than the diameter of cylinder 48*a,* to which a control pressure is introduced from intermediate pressure chamber 44 via passageway 46*b*. The pressure of operating chamber 47 exerts a directional force on piston 43 while coil spring 42*b* urges piston 43 in a direction opposite to the directional force of the pressure of operating chamber 47. Thus, the position of piston 43 is controlled so as to maintain a position at which the force exerted by coil spring 42*b* and the force exerted by the pressure in operating chamber 47 are balanced.

On fixed end plate 251, a plurality of bypass holes 51*a,* 51*a'*, 51*b,* 51*b'* are provided, such that they penetrate fixed end plate 251 perpendicularly. When piston 43 is completely recessed within cylinder 48*a* (i.e., in a position adjacent operating chamber 47), cylinder 48*a* is placed in communication via bypass holes 51*a,* 51*b* with compression chambers P1, P2 which are enclosed by the orbiting scroll 26 and fixed scroll 25. At the same time, cylinder 48*a* is placed in communication via bypass holes 51*a'*, 51*b'* with low pressure chamber 54*a*. Therefore, compression chambers P1, P2 may be placed in communication with low pressure chamber 54*a* via cylinder 48*a*. The outlet portion of cylinder 48*a* is always in communication with suction chamber 40. Low pressure chamber 54*a* is always in communication via passageway 54*a'* with suction chamber 40.

Figure 3:
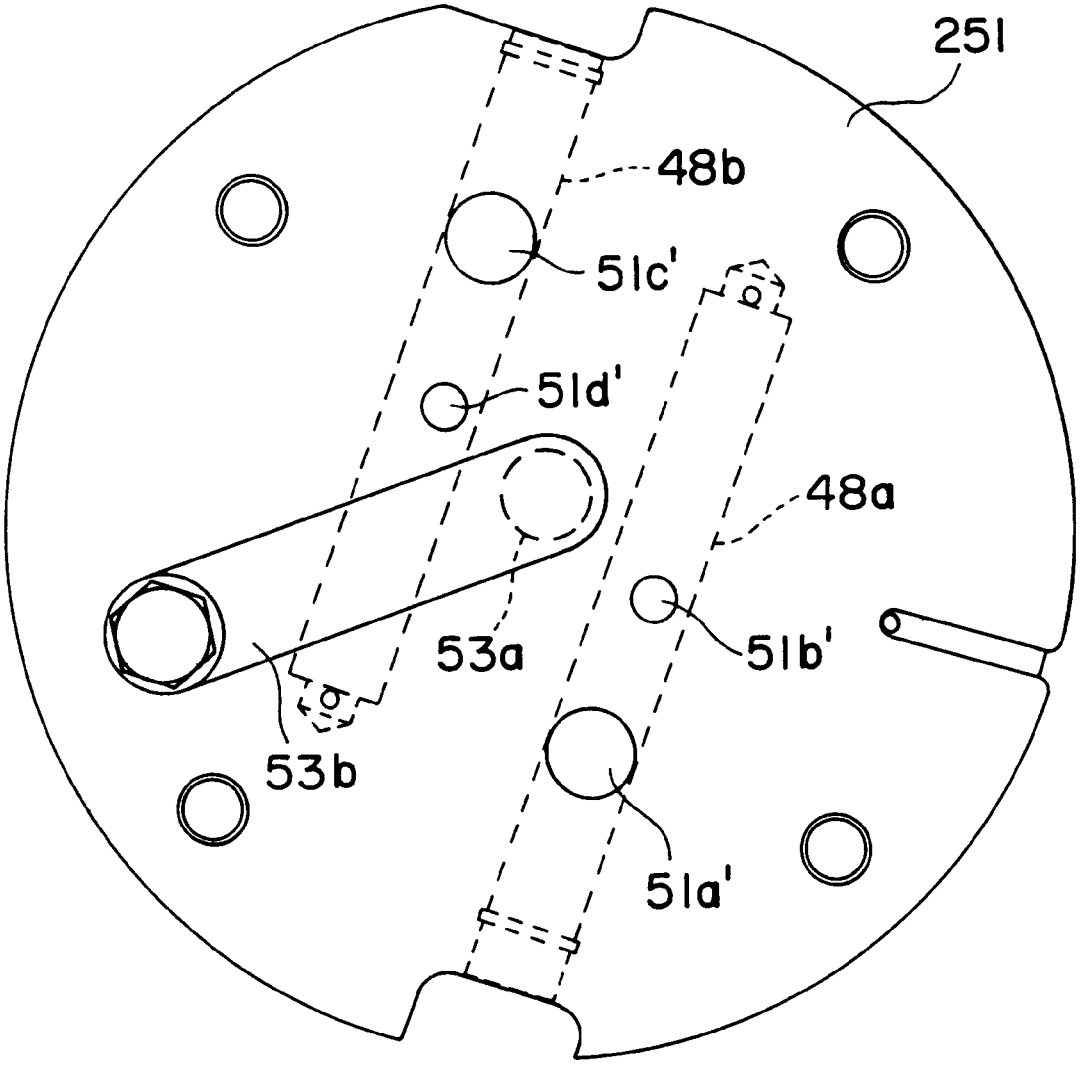
FIG. 3 is a back view of a partially assembled end plate of a fixed scroll of a scroll-type variable displacement compressor according to the first embodiment of the present invention.

With reference to FIG. 3, another cylinder 48*b* of the same structure as cylinder 48*a* may be formed within end plate 251. Cylinder 48*b* is disposed antiparallel to cylinder 48*a* (i.e., the operating chambers 47 are on opposite sides of each plate 251). On cylinder 48*b,* four bypass holes are formed of which only bypass holes 51*c'*, 51*d'* are depicted in FIG. 3. The two bypass holes not shown are formed on a side of end plate 251 opposite bypass holes 51*c'*, 51*d'*. All four bypass holes in cylinder 48*b* perform similar functions to bypass holes 51*a,* 51*b,* 51*a'*, 51*b'* in cylinder 48*a*.

Figure 4:
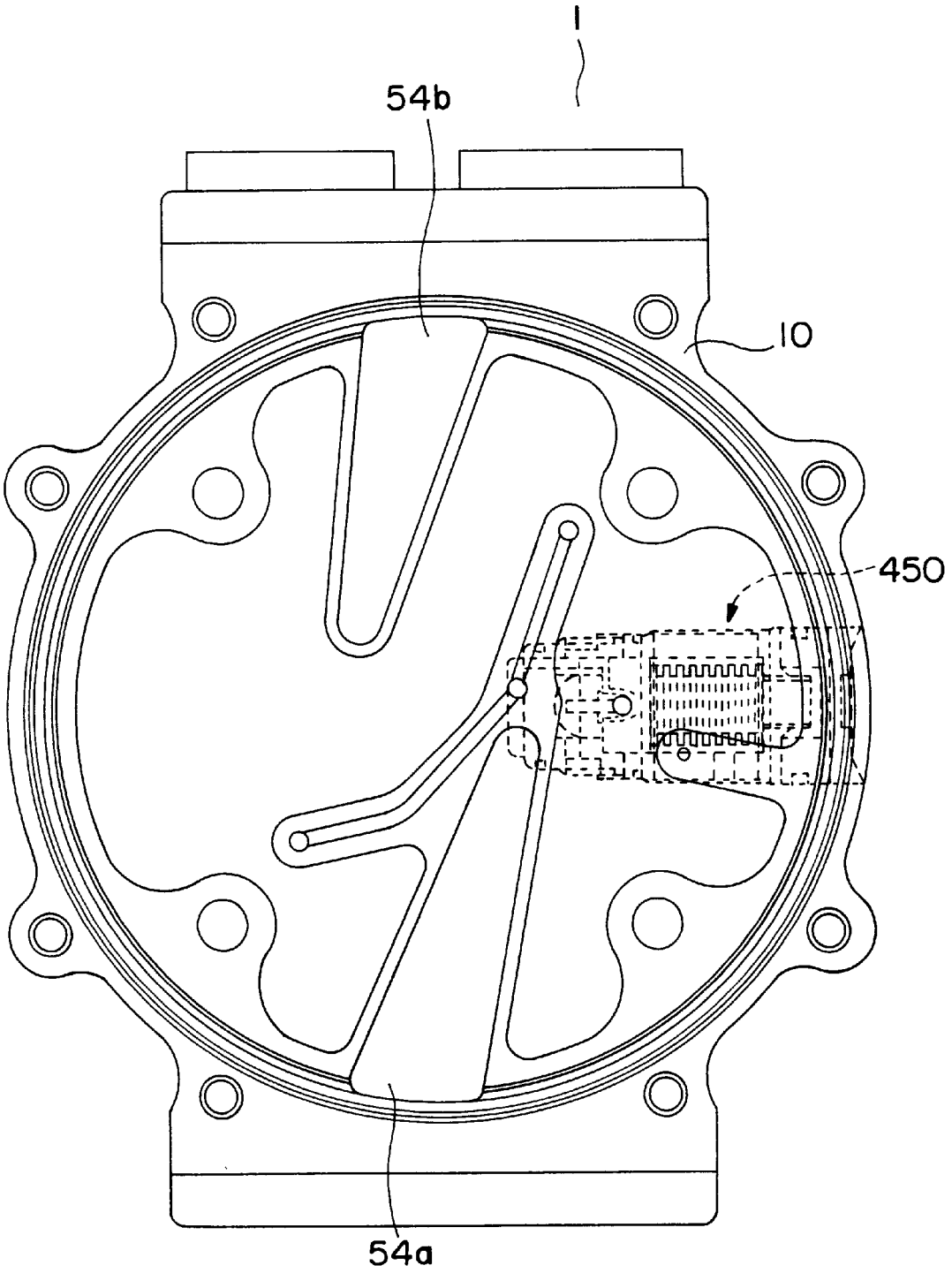
FIG. 4 is a transverse sectional view of a scroll-type variable displacement compressor according to the first embodiment of the present invention along the line IV-IV' in FIG. 2.

FIG. 4 is a cross-sectional view of the low pressure chambers 54*a* and 54*b* as viewed from the rear side of the compressor. As described above, low pressure chamber 54*a* may be placed in communication with the cylinder 48*a* shown in FIG. 3. In a similar way, low pressure chamber 54*b* may be placed in communication with the cylinder 48*b* via bypass holes 51*c'* and 51*d'*.

With reference once again to FIG. 2, the operation of control valve mechanism 450 is now explained. Control valve mechanism 450 comprises bellows 45, first adapter member 60, globe valve body 45*b*, conically coiled spring 61, second adapter member 62, and rod 45*c*. A bellows chamber 45*e* surrounds bellows 45 and is in communication with suction chamber 40 via passageway 46*a*. Intermediate pressure chamber 44 is in communication with operating chamber 47 via passageway 46*b*. High pressure chamber 45*d* is in communication via passageway 45*h* with discharge chamber (not shown). When the compressor is operating, the refrigerant gas introduced into the high pressure chamber 45*d* exerts an upward force on the bottom face of rod 45*c* to push it up.

Between the peripheral surface of rod 45*c* and the inner surface of the through hole of second adapter member 62 for rod 45*c*, a small gap is formed. Through this gap, the refrigerant gas introduced into high pressure chamber 45*d* may leak to intermediate pressure chamber 44 at any time. The gas in intermediate pressure chamber 44, then, is conducted to operating chamber 47, from which it exerts a downward force upon the top of the piston 43 to push down it.

The upper part of bellows 45 is fixed to case 63. A projection 45*f* is provided on the bottom face of bellows 45 and is slidably accommodated within small through hole 60*h*. Because the upper part of bellows 45 is fixed, projection 45*f* moves in and out of small through hole 60*h*, according to the contraction of bellows 45. Between the peripheral surface of projection 45*f* and the inner surface of small through hole 60*h*, a small gap is also formed. Thus, if the pressure within intermediate pressure chamber 44 is greater than the pressure within bellows chamber 45*e*, refrigerant gas may leak from the intermediate pressure chamber 44 to bellows chamber 45*e* through this gap.

When the compressor is operating, a downward force exerted by projection 45*f* of bellows 45 and a upward force exerted by conically coiled spring 61 and rod 45*c* act on globe valve body 45*b*. When the upward force acting on globe valve body 45*b* is greater than the downward force, globe valve body 45*b* shifts within intermediate pressure chamber 44 upwardly and closes the gap between the peripheral surface of the projection 45*f* and the inner surface of small through hole 60*h*, thereby blocking leakage of refrigerant from intermediate pressure chamber 44 to bellows chamber 45*e*. If, however, the downward force acting on globe valve body 45*b* is greater than the upward force, globe valve body 45*b* shifts within intermediate pressure chamber 44 downwardly and opens the gap between the peripheral surface of projection 45*f* and the inner surface of small through hole 60*h*, thereby permitting refrigerant gas to leak from intermediate pressure chamber 44 to bellows chamber 45*e*.

When the thermal load for the refrigeratory circuit is high, for example, when starting the compressor, the pressure in suction chamber 40 also is relatively high. Then the pressure in bellows chamber 45*e*, which is in communication with suction chamber 40, is accordingly high. Consequently, bellows 45 contracts. Due to the contraction of bellows 45, globe valve body 45*b* displaces upwardly and closes the gap of small through hole 60*h* in first adapter member 60. As a result the refrigerant gas in intermediate pressure chamber 44, which has leaked from the high pressure chamber 45*d* via the gap around the peripheral of rod 45*c* is conducted to operating chamber 47. In the operating chamber, pressure grows to a magnitude such that it overcomes the force of coil spring 42*b*, and then pushes down piston 43 until the movement of that piston is restricted by stopper 42*a*.

When the thermal load for the refrigeratory circuit is low, for example, when the compressor has been in operation for an extended period of time and has cooled the ambient air, the pressure in suction chamber 40 and in bellows chamber 45*e* decreases. Bellows 45 then expands, and projection 45*f* pushes down globe valve body 45*b*. As a result, refrigerant gas leaks through the gap of small through hole 60*h* of first adapter member 60. Consequently, a portion of the refrigerant gas in intermediate pressure chamber 44, which has leaked from high pressure chamber 45*d* via the gap around the peripheral surface of rod 45*c*, escapes via the gap of small hole 60*h* into bellows chamber 45*e* through passageway 46*a* and into suction chamber 40. Therefore, a lesser amount of the refrigerant gas, relative to the case of high thermal load, is conducted from intermediate pressure chamber 44 into operating chamber 47. As a result, sufficient pressure to overcome the force of coil spring 42*b* may not be attained in operating chamber 47, thereby permitting piston 43 to shift gradually in the direction of operating chamber 47.

By the mechanisms described above, the position of piston 43 within cylinder 48*a* is adjusted in response to the thermal load of the refrigeratory circuit. In particular, when the thermal load is high, piston 43 shifts to the position restricted by stopper 42*a*, closing each pair of bypass holes 51*a*, 51*a'*, 51*b*, 51*b'*, thereby blocking the return of refrigerant gas from compression chambers P1, P2 to suction chamber 40. Consequently, the compressor operates at its full capacity. On the contrary, as the thermal load decreases and becomes low, piston 43 shifts toward operating chamber 47, thereby opening the pairs of bypass holes 51*a*, 51*a'*, 51*b*, 51*b'* sequentially. In this condition, the refrigerant gas from compression chambers P1, P2, which are enclosed by orbiting scroll 26 and fixed scroll 25, is allowed to return to suction chamber 40, thereby permitting the compressor to operate at its minimum capacity in this state.

A primary object of the present invention is to improve the minimum capacity of the scroll-type variable displacement compressor without increasing the size or weight of the compressor. Another object of the present invention is to provide a low pressure chamber 54*a* that functions as a branch path for returning gas, low pressure chamber 54*a* being located within the housing of the scroll-type variable displacement compressor in order to increase the effective cross-sectional area of the passage for the returning gas. By increasing the effective cross-sectional area for the returning gas passage, the pressure loss between the compression chamber and the suction chamber may be reduced, and the net quantity of the returning gas may be increased. Ultimately, the operative minimum capacity of the compressor may be reduced below that of comparable prior art compressors.

Figure 1:
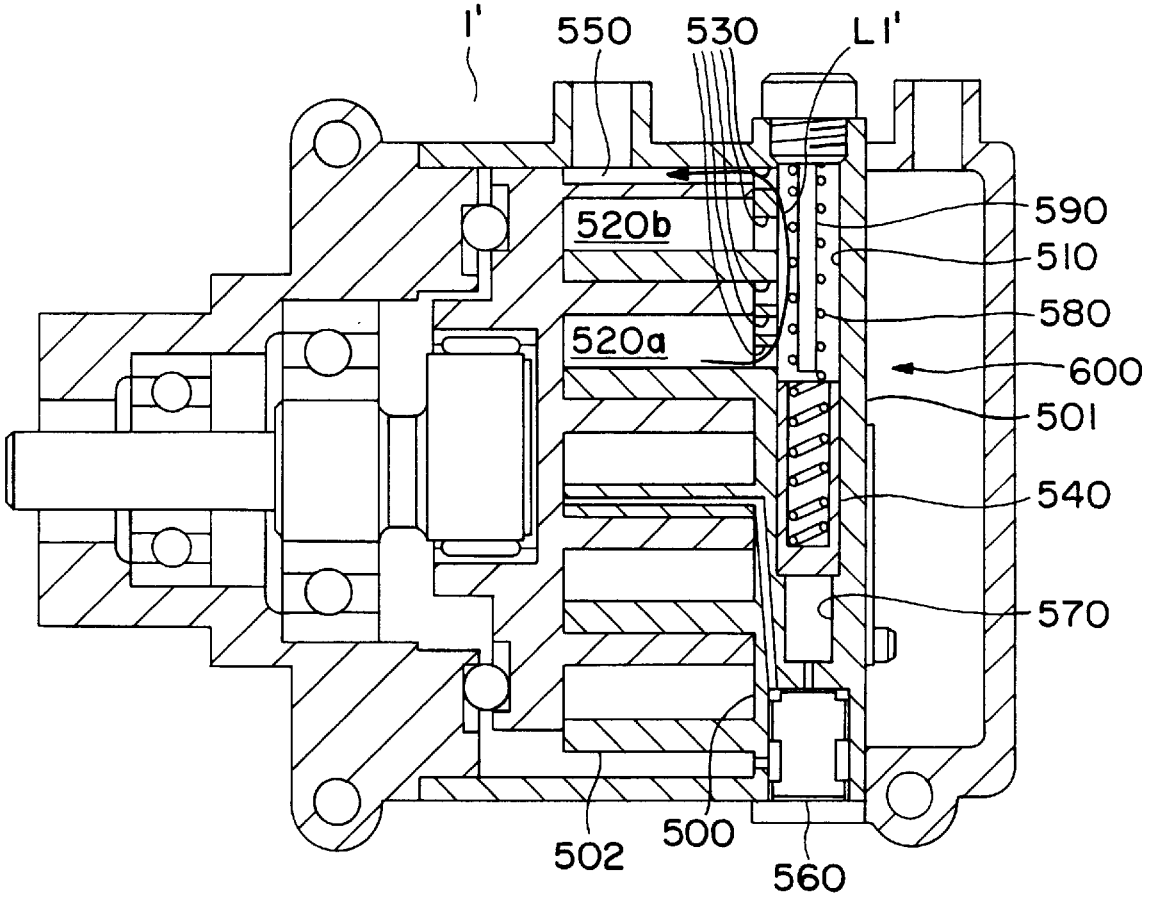
FIG. 1 PRIOR ART
FIG. 1 is a cross-sectional view of a scroll-type variable displacement compressor according to the prior art.

In FIG. 2, two representative paths of returning gas in the present invention are indicated as L1 and L2. Path L1 begins at compression chamber P1, passes through bypass hole 51*b*, through cylinder 48*a*, and terminates at suction chamber 40. Path L2 begins at compression chamber P1, passes through bypass hole 51*b*, cylinder 48*a*, bypass hole 51*b'*, and low pressure chamber 54*a*, and terminates at suction chamber 40. Compared with the structure of a conventional scroll-type variable displacement compressor, as shown in FIG. 1, wherein only path L1' is provided for the returning gas, a compressor according to the present invention, as shown in FIG. 2, is provided with path L2 in addition to path L1. Path L1 corresponds to path L1' depicted in FIG. 1.

The additional path L2 reduces the pressure loss of returning gas significantly, because the effective cross-sectional area of the passage for returning gas is significantly increased by bypass hole 51*b'* and by the low pressure chamber 54*a*. In particular, the ratio of the quantities of the returning gas via path L1 and path L2 may be estimated to be about 40 percent and 60 percent respectively, based on the relative cross-sectional areas of paths L1 and L2. Thus, the pressure loss of returning gas is greatly reduced, and the minimum capacity of the compressor according to the present invention may be effectively reduced to the expected value.

Figure 5:
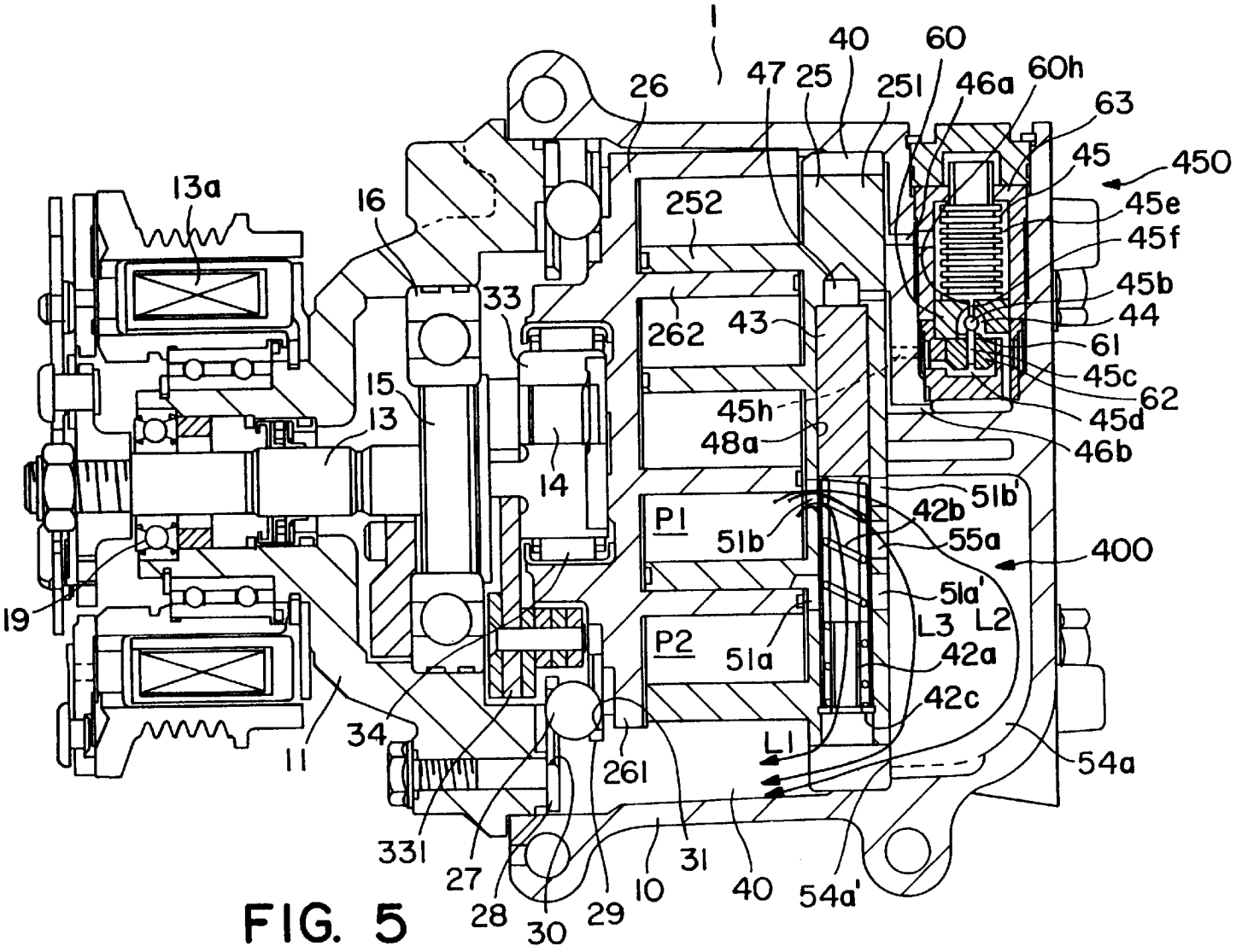
FIG. 5 is a cross-sectional view of a scroll-type variable displacement compressor according to a second embodiment of the present invention.
Figure 6:
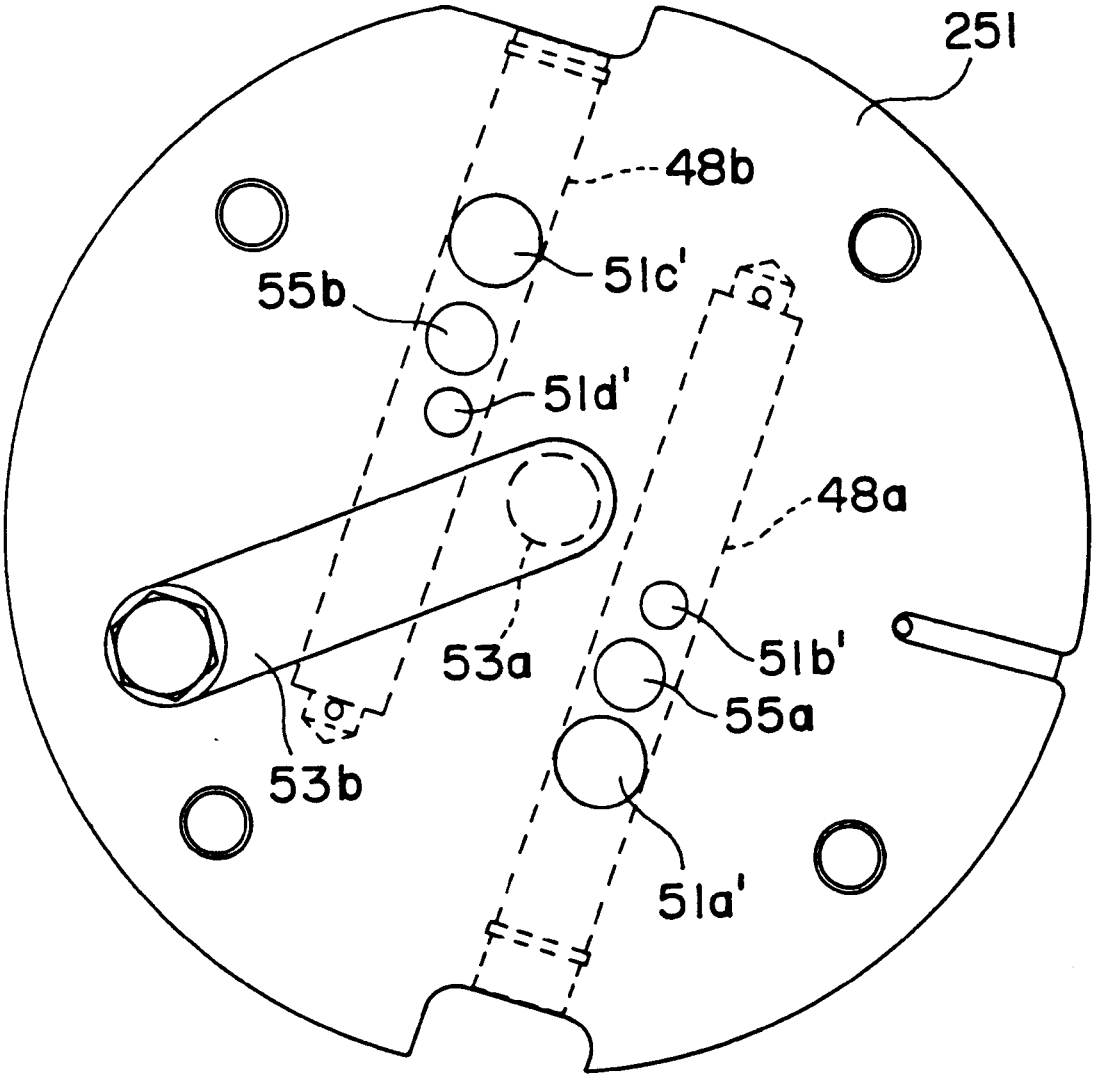
FIG. 6 is a rear view of a partially assembled end plate of a fixed scroll of a scroll-type variable displacement compressor according to the second embodiment of the present invention.

In FIGS. 5 and 6, a second embodiment of the present invention is shown. Considering the second embodiment of the present invention with the first embodiment, an additional bypass hole 55*a* is provided between bypass holes 51*b'* and 51*a'*. As a result, a returning path L3 is provided in addition to returning paths L1 and L2, further reducing the pressure loss of the returning gas. Thus, the minimum operative capacity of such a compressor may be further reduced in comparison to a compressor with paths L1 and L2. With reference to FIG. 6, cylinder 48*a* is provided with an additional bypass hole 55*a* between bypass holes 51*a'* and 51*b',* and cylinder 48*b* is provided with an additional bypass hole 55*b* between bypass holes 51*c'* and 51*d'*.

Figure 7:
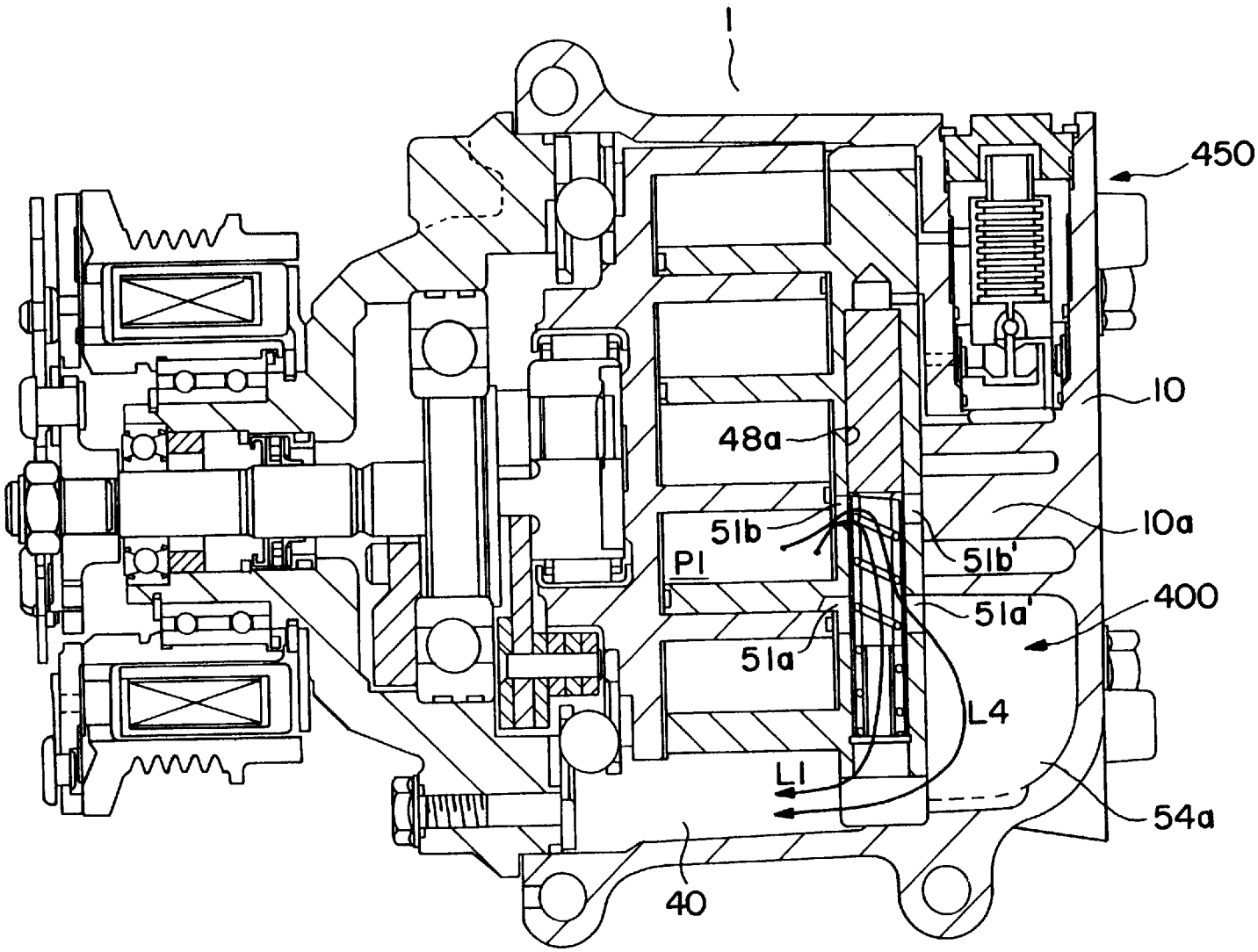
FIG. 7 is a cross-sectional view of a scroll-type variable displacement compressor according to a third embodiment of the present invention.

In FIG. 7, a third embodiment of the present invention is shown. The third embodiment illustrates a situation in which bypass hole 51*b'* is closed by a block 10*a* in the housing 10. Although bypass hole 51*b'* is closed, a branch path L4 is provided, as shown in FIG. 7, which begins at from compression chamber P1, passes through the bypass hole 51*b,* cylinder 48*a,* bypass hole 51*a',* and low pressure chamber 54*a,* and terminates at the suction chamber 40.

As explained thus far, the scroll-type variable displacement compressor according to the present invention may reduce the pressure loss of the returning gas and also decreases the minimum capacity of the compressor by providing a branch path via the low pressure chamber utilizing a portion of the housing in addition to the conventional returning path via only the cylinder. Moreover, the present invention may attain these purposes without an accompanying increase of size in the axial direction of the compressor or increase in weight of the compressor.

Although the present invention has been described in detail in connection with preferred embodiments, the invention is not limited thereto. It will be understood by those of ordinary skill in the art that variations and modifications may be made within the scope of this invention, as defined by the following claims.

What is claimed is:

1. A scroll-type variable displacement compressor for use with refrigerant gas comprising: a housing; a front plate; a drive shaft; an orbiting scroll; a converting mechanism to convert rotational motion of said drive shaft into orbiting motion for said orbiting scroll; a mechanism to prevent rotational motion of said orbiting scroll; a fixed scroll; a piston valve mechanism which provides a first return path for a portion of refrigerant gas from a plurality of compression chambers enclosed by said orbiting scroll and said fixed scroll to a suction chamber of the compressor, said first return path being provided for capacity control; a control valve mechanism which supplies a control pressure to said piston valve mechanism; and a low pressure chamber which provides a second return path for a portion of the returning refrigerant gas; said piston valve mechanism comprising a cylinder which is formed within an end plate of said fixed scroll so that an axis of said cylinder lies in a plane perpendicular to a longitudinal axis of compressor, said cylinder having an interior surface with a plurality of pairs of bypass holes which penetrate said end plate of said fixed scroll and said cylinder perpendicularly from one or more of said compression chambers through said low pressure chamber, a piston which is slidably accommodated within said cylinder to open or close said bypass holes, a coil spring which urges said piston in a direction opposite a force of said control pressure, a stopper which limits displacement of said piston, and a snap ring which retains the piston and the coil spring within said cylinder; and said low pressure chamber being disposed within a portion of said housing and being in communication with said suction chamber at all times.

2. The compressor of claim 1, wherein an additional bypass hole is provided between at least one pair of said bypass holes through which said cylinder communicates with said low pressure chamber.

3. The scroll-type variable displacement compressor of claim 1, wherein at least one of said bypass holes through which said cylinder communicates with said low pressure chamber is blocked.

* * * * *